US007904010B2

(12) United States Patent
Meguro et al.

(10) Patent No.: US 7,904,010 B2
(45) Date of Patent: Mar. 8, 2011

(54) BELT UNIT, TRANSFER BELT UNIT, AND IMAGE FORMING APPARATUS

(75) Inventors: Yuuji Meguro, Hyogo (JP); Tomofumi Inoue, Osaka (JP); Kohji Hatayama, Kanagawa (JP); Mitsutoshi Kichise, Osaka (JP); Takeru Muramatsu, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 430 days.

(21) Appl. No.: 12/010,799

(22) Filed: Jan. 30, 2008

(65) Prior Publication Data

US 2008/0193173 A1 Aug. 14, 2008

(30) Foreign Application Priority Data

Feb. 9, 2007 (JP) ..... 2007-030104
Oct. 5, 2007 (JP) ..... 2007-262770

(51) Int. Cl.
*G03G 15/01* (2006.01)

(52) U.S. Cl. ..... 399/299; 399/302; 399/303

(58) Field of Classification Search ..... 399/298, 399/299, 302, 303, 308, 312, 313, 66
See application file for complete search history.

(56) References Cited

U.S. PATENT DOCUMENTS 6,889,027 B2 * 5/2005 Tachiki et al. ..... 399/297

FOREIGN PATENT DOCUMENTS

| | | | |
|---|---|---|---|
| JP | 08-339129 | | 12/1996 |
| JP | 2001-337497 | | 12/2001 |
| JP | 2003-186313 | | 7/2003 |
| JP | 2004-084729 | | 3/2004 |
| JP | 2004084729 | A * | 3/2004 |
| JP | 2005-266269 | | 9/2005 |
| JP | 2006153144 | A * | 6/2006 |

* cited by examiner

*Primary Examiner* — Robert Beatty
(74) *Attorney, Agent, or Firm* — Harness, Dickey & Pierce, P.L.C.

(57) ABSTRACT

A belt unit includes a belt, a contact member, a movable member, an eccentric cam, a contact-separation mechanism, and a braking unit. The contact member is configured to come into contact with the belt. The contact-separation mechanism allows the movable member to move according to the rotation of the eccentric cam to control contact and separation between the contact member and the belt. The braking unit controls the rotation of the eccentric cam by a predetermined angle.

9 Claims, 5 Drawing Sheets

BELT UNIT, TRANSFER BELT UNIT, AND IMAGE FORMING APPARATUS

CROSS-REFERENCE TO RELATED APPLICATIONS

The present application claims priority to and incorporates by reference the entire contents of Japanese priority documents 2007-030104 filed in Japan on Feb. 9, 2007 and 2007-262770 filed in Japan on Oct. 5, 2007.

BACKGROUND OF THE INVENTION

1. Field of the Invention

The present invention relates to a mechanism for controlling contact and separation between photosensitive elements and a belt of an image forming apparatus.

2. Description of the Related Art

Among conventional technologies related to a mechanism for controlling contact and separation between photosensitive elements and a belt of an image forming apparatus, for example, Japanese Patent Application Laid-open No. 2003-186313 discloses a contact-separation mechanism using a cam. Japanese Patent Application Laid-open No. 2001-337497 discloses a technology in which a pinion gear is additionally used as a braking member to absorb impact caused by the operation of a contact-separation mechanism. Japanese Patent Application Laid-open No. H8-339129 discloses another conventional technology in which a braking member (a buffer material) that comes into contact with an outer periphery of an eccentric cam is arranged in a transfer belt unit that includes a driving unit (a main motor) for rotating the cam. In this conventional technology, because the braking member is mounted on a swinging lever, the cam and the braking member are in contact with each other all the time, which leads to a larger driving torque of the cam, and an increase in cost and apparatus size.

SUMMARY OF THE INVENTION

It is an object of the present invention to at least partially solve the problems in the conventional technology.

According to an aspect of the present invention, there is provided a belt unit. The belt unit includes a belt; a contact member that is configured to come into contact with the belt; a movable member; an eccentric cam; a contact-separation mechanism that allows the movable member to move based on rotation of the eccentric cam to control contact and separation between the contact member and the belt; and a braking unit that controls the rotation of the eccentric cam by a predetermined angle.

According to another aspect of the present invention, there is provided a transfer belt unit for an image forming apparatus. The transfer belt unit includes a belt unit including a belt, an image carrier that is configured to come into contact with the belt; a movable member, an eccentric cam, a contact-separation mechanism that allows the movable member to move based on rotation of the eccentric cam to control contact and separation between the contact member and the belt, and a braking unit that controls the rotation of the eccentric cam by a predetermined angle; and a transfer member that is connected to the movable member and is located to face the image carrier via the belt. The contact-separation mechanism controls contact and separation between the image carrier and the belt by moving the transfer member in a direction of the image carrier and in a direction opposite to the image carrier through a movement of the movable member.

According to still another aspect of the present invention, there is provided an image forming apparatus including a transfer belt unit. The transfer belt unit includes a belt unit including a belt, an image carrier that is configured to come into contact with the belt, a movable member, an eccentric cam, a contact-separation mechanism that allows the movable member to move based on rotation of the eccentric cam to control contact and separation between the contact member and the belt, and a braking unit that controls the rotation of the eccentric cam by a predetermined angle; and a transfer member that is connected to the movable member and is located to face the image carrier via the belt. The contact-separation mechanism controls contact and separation between the image carrier and the belt by moving the transfer member in a direction of the image carrier and in a direction opposite to the image carrier through a movement of the movable member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
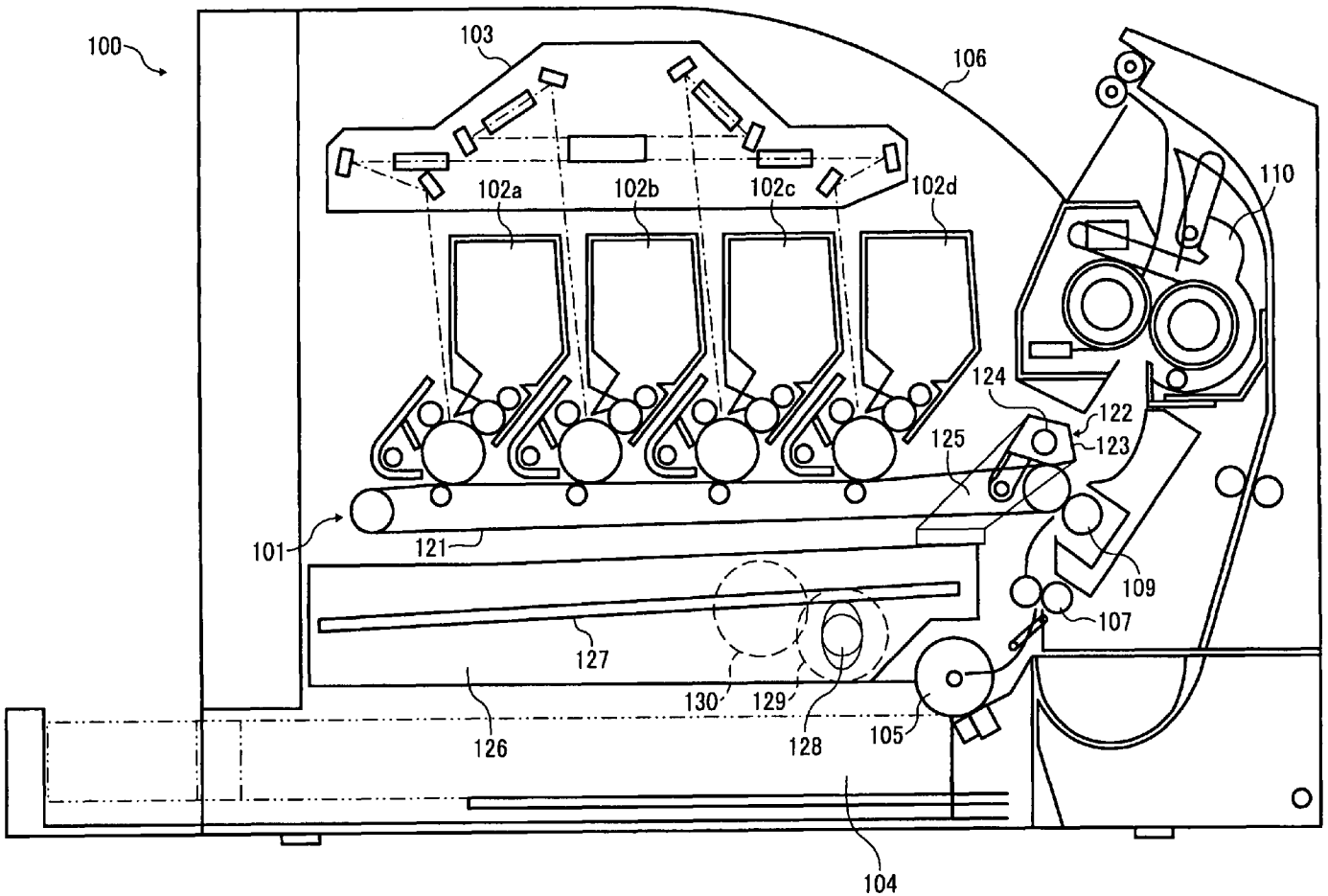
FIG. 1 is a schematic diagram of an example of an image forming apparatus according to an embodiment of the present invention.

FIG. 1 is a schematic diagram of an example of an image forming apparatus according to an embodiment of the present invention. In the following, the image forming apparatus is explained as, for example, a tandem color image forming apparatus. The image forming apparatus includes process cartridges 102*a*, 102*b*, 102*c*, and 102*d* for different colors: yellow, cyan, magenta, and black, which are detachably mounted on an apparatus body 100. The apparatus body 100 includes an exposure unit 103, an intermediate transfer unit 101, a sheet feeding tray 104, and a fixing unit 110.

The process cartridges 102*a*, 102*b*, 102*c*, and 102*d* are each installed at a predetermined position in the apparatus body 100. A toner image is formed in each of the process cartridges 102*a*, 102*b*, 102*c*, and 102*d* and is primarily transferred onto an intermediate transfer belt 121. Then, a recording medium (sheet) is fed from the sheet feeding tray 104 and is conveyed to a pair of registration rollers 107 through a sheet feeding roller 105. The registration rollers 107 adjusts the sheet such that the sheet matches the toner image formed on the intermediate transfer belt 121 between a pair of secondary transfer rollers 109. The toner image is secondarily transferred onto the sheet. The toner image is fused onto the sheet by heat and pressure while the sheet is passing thorough a nip between rollers of the fixing unit 110, and the sheet is discharged to a sheet discharge tray 106.

After the secondary transfer, waste toner that remains on the intermediate transfer belt 121 not having been transferred onto the sheet is removed by a cleaning blade 123 of a cleaning unit 122 that is in contact with the intermediate transfer belt 121. The waste toner is conveyed by a screw 124 of the cleaning unit 122 in an axial direction of the screw 124. The waste toner conveyed to an end of the cleaning unit 122 passes through a joint 125 and is collected in a waste toner bottle 126. At the same time, an agitating plate 127 agitates the waste toner in the waste toner bottle 126 to fill the waste toner bottle 126 with the waste toner efficiently. The agitating plate 127 is in contact with an agitating shaft 128 that penetrates through the waste toner bottle 126, and driven by an agitating gear 129 at an end of the agitating shaft 128, which meshes with a body gear 130 arranged on the apparatus body 100.

Figure 2:
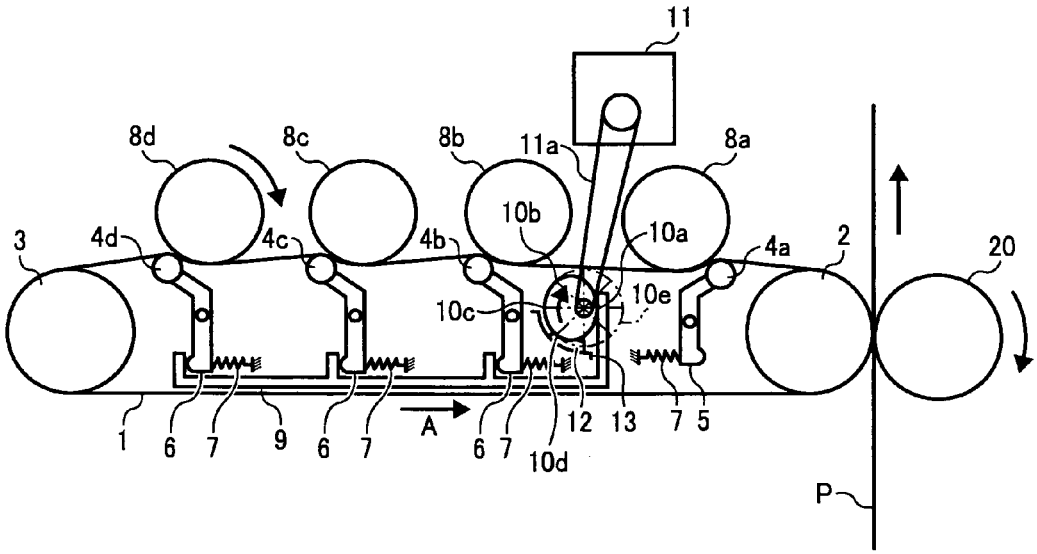
FIG. 2 is a schematic diagram of a transfer belt unit including a belt unit according to a first embodiment of the present invention.
Figure 3:
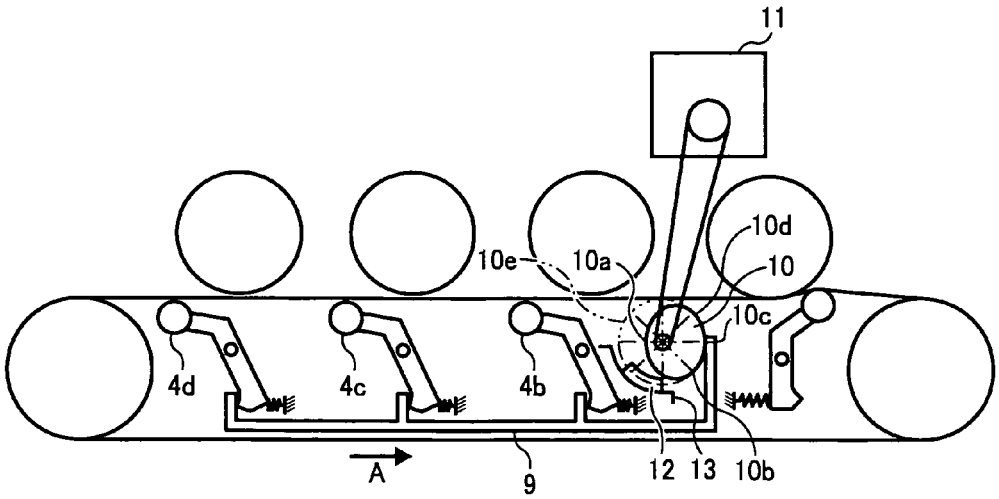
FIGS. 3 to 5 are schematic diagrams for explaining contact-separation operation of primary transfer rollers of the image forming apparatus shown in FIG. 1.
Figure 4:
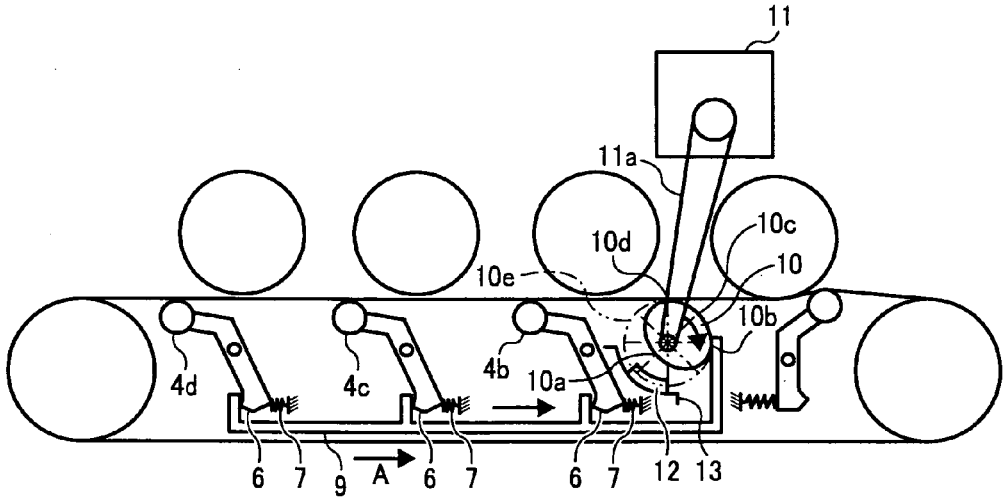
Figure 5:
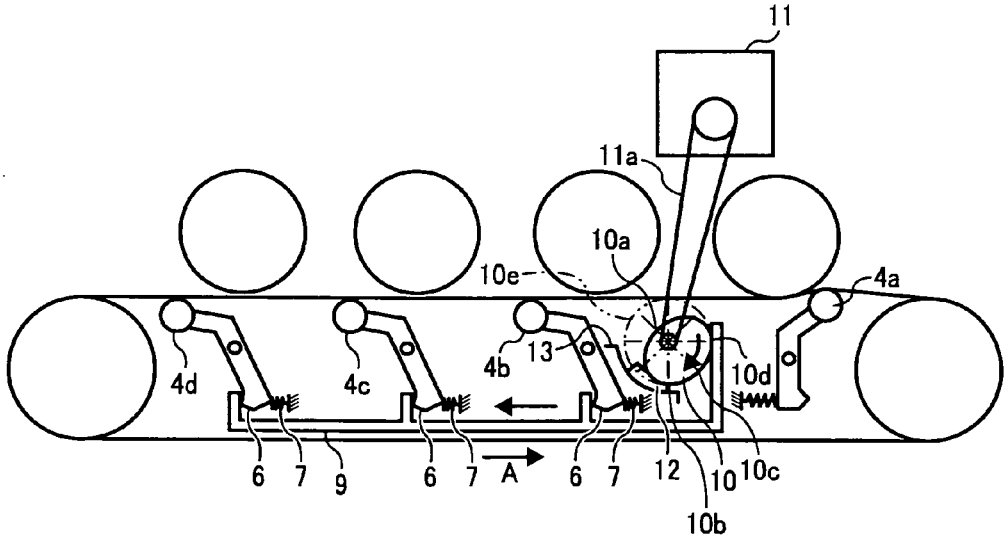

FIG. 2 is a schematic diagram of a transfer belt unit including a belt unit according to a first embodiment of the present invention, and depicts a typical configuration of a relevant part of an image forming apparatus that includes the transfer belt unit. FIGS. 3 to 5 are schematic diagrams for explaining movements of transfer members, and contact and separation between contact members and an intermediate transfer belt in the transfer belt unit.

An intermediate transfer belt 1 (corresponding to the intermediate transfer belt 121 described above) is extends around a driving roller 2 and a driven roller 3. The intermediate transfer belt 1 is driven to rotate in a direction indicated by an arrow A in FIG. 2 based on rotation of the driving roller 2 by a driving unit (not shown). Primary transfer rollers 4*a* to 4*d* are arranged inside the intermediate transfer belt 1 and are rotatably supported by arms 5 and 6. That is, the arms 5 and 6 can rotate in a left-and-right direction about a rotation shaft arranged in the middle thereof while supporting the primary transfer rollers 4*a* to 4*d* on the ends, respectively. Below the arms 5 and 6 are springs 7 that bias the primary transfer rollers 4*a* to 4*d* to bring them into contact with photosensitive elements 8*a* to 8*d* serving as an image carrier.

The photosensitive element 8*a* is used to form a black image. Each of the photosensitive elements 8*b* to 8*d* is used to form a color image (for any one of magenta, yellow, and cyan). A combination of these colors forms a single-color image or a color image.

Around each of the photosensitive elements 8*a* to 8*d* (hereinafter, "photosensitive element 8" unless particularly needed), a charging unit, an exposure unit, a developing unit, a cleaning unit, and the like (not shown) that are used for a known electrophotography are arranged clockwise. The charging unit uniformly charges a surface of the photosensitive element 8. The exposure unit forms a latent image based on a read image on the surface of the photosensitive element 8 through a light-emitting diode (LED) or a laser diode (LD). The developing unit forms a toner image (a visible image) by adhering powder such as toner to the latent image on the photosensitive element 8. The toner image on the photosensitive element 8 is primarily transferred onto the intermediate transfer belt 1. After the primary transfer, toner remaining on the surface of the photosensitive element 8 is removed by the cleaning unit. Cleaning is not necessarily performed by the cleaning unit and can be performed by various known methods. Among them is a cleanerless method by which remaining toner after the primary transfer are removed by a developing unit instead of providing such a cleaning unit on the photosensitive element 8.

The primary transfer is electrostatically performed by applying bias to the primary transfer rollers 4*a* to 4*d* by a bias applying unit (not shown). A primary transfer member is not limited to a roller, and a brush can be used. As shown in FIGS. 2 to 5, a perpendicular that is drawn through a center of the photosensitive element 8 to a line that couples the center of the driving roller 2 and that of the driven roller 3, i.e., a surface of the intermediate transfer belt 1 extending around the rollers 2 and 3, and a perpendicular that is drawn through a center of each of the primary transfer rollers 4*a* to 4*d* to the surface of the intermediate transfer belt 1 are not aligned. The primary transfer rollers 4*a* to 4*d* push the intermediate transfer belt 1 against the photosensitive elements 8*a* to 8*d* to bring it into contact with part of a surface of the photosensitive elements 8*a* to 8*d*. In such an offset transfer printing, the primary transfer rollers 4 move by a large amount, resulting in larger amount of eccentricity of an eccentric cam 10. As the amount of eccentricity of the eccentric cam 10 increases, a friction force between the eccentric cam 10 and a slider 9 increases, which is likely to cause an increase in torque.

Toner images that are sequentially primarily transferred from the photosensitive element 8 onto the intermediate transfer belt 1 to be superimposed thereon to form a color toner image. An opposing roller 20 is arranged opposite to the driving roller 2. A recording medium P such as a sheet that is conveyed by a sheet conveying unit (not shown) passes through between the driving roller 2 and the opposing roller 20. The toner images superimposed on the intermediate transfer belt 1 are carried to a position between the driving roller 2 and the opposing roller 20 and are secondarily transferred onto the recording medium P all at once while the recording medium P is passing through between the driving roller 2 and the opposing roller 20.

The secondary transfer (repulsion transfer) is electrostatically performed by applying bias with the same polarity as a charging polarity of toner to the driving roller 2 by the bias applying unit. Alternatively, the secondary transfer (attraction transfer) can be performed by applying bias with a polarity opposite to a charging polarity of toner to the opposing roller 20.

After the secondary transfer, the recording medium P passes through the fixing unit, and the toner on the recording medium P is fixed to form an image. The transfer and fixing can be performed simultaneously by applying heat at the time of the secondary transfer.

As shown in FIG. 2, the arms 6 and the primary transfer rollers 4*b*, 4*c*, and 4*d* are connected via the slider 9 to the eccentric cam 10. A driving unit 11 connected to the eccentric cam 10 causes the arms 6 and the primary transfer rollers 4*b*, 4*c*, and 4*d* to reciprocate in a direction of the photosensitive elements 8*b* to 8*d* or in a direction opposite thereto, respectively. Thus, contact and separation between the intermediate transfer belt 1 and the photosensitive elements 8*b* to 8*d* is controlled.

Figure 6:
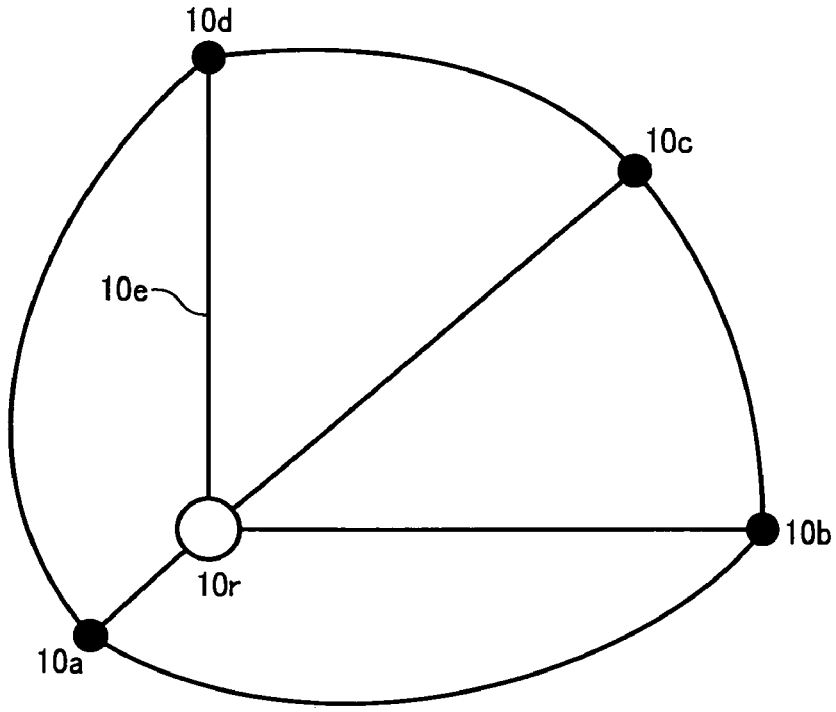
FIG. 6 is an enlarged view of an example of an eccentric cam shown in FIGS. 3 to 5.

FIG. 6 is an enlarged view of the eccentric cam 10. The eccentric cam 10 rotates about a rotation center 10*r*. A rotation radius becomes larger from a point 10*a* to a point 10*b* and is substantially the maximum from the point 10*b* through a point 10*c* (fulcrum) to a point 10*d*, which is taken as an equilibrium area in which a force from the slider 9 cannot rotate the eccentric cam 10. Because the rotation radius is fixed, a driving torque is also fixed. When the primary transfer rollers 4*b* to 4*d* are separated from the intermediate transfer belt, the separation is maintained by stopping the rotation of the eccentric cam 10 in the equilibrium area 10*b* to 10*d*.

When color printing is performed, pressure is applied to the primary transfer rollers 4*b* to 4*d* in such a manner as to always be in contact with the photosensitive elements 8*b* to 8*d*. Accordingly, it is necessary to move the slider 9 with a larger force than the applied pressure to separate the primary transfer rollers 4*b* to 4*d* from the photosensitive elements 8*b* to 8*d*. A rotation torque of the eccentric cam 10 gradually increases from the point 10*a* to the point 10*b* that is a start of the equilibrium area, and reaches the maximum value near the point 10*b* at a contact point between the eccentric cam 10 and the slider 9 as shown in FIG. 3.

The rotation torque is fixed and smaller than the maximum value in the equilibrium area 10*b* to 10*d*. The rotation torque gradually decreases from the point 10*d* that is the end of the equilibrium area to the point 10*a*. However, the spring 7 presses the slider 9, resulting in that the eccentric cam 10 is applied with a force to accelerate its rotation besides the rotation torque caused by the driving unit 11.

In conventional technologies, the driving unit 11 and the eccentric cam 10 are connected by a link arm 11*a* that is a transfer mechanism such as a gear chain or a timing belt and pulleys. However, gears or pulleys may cause a backlash. Accordingly, collision noise may occur between gears or between pulleys while the rotation of the eccentric cam 10 is accelerated after the equilibrium area of the eccentric cam 10 separates from the slider 9. Besides, collision noise may occur between the slider 9 and the eccentric cam 10, between the slider 9 and the arms 6, and between the primary transfer rollers 4*b* to 4*d* and the intermediate transfer belt 1. This significantly reduces the commercial value of the transfer belt unit.

On the other hand, according to the first embodiment, a braking member 12 is arranged to come into contact with an outer periphery of the eccentric cam 10. The braking member 12 always applies a braking force equal to or larger than an accelerating force caused by the spring 7 to the eccentric cam 10 to prevent acceleration of the rotation of the eccentric cam 10. The braking member 12 is not arranged at a position where the eccentric cam 10 comes into contact with the slider 9 but on a housing 13 where a rotation shaft of the eccentric cam 10 is supported at a fixed position. Thus, the eccentric cam 10 is not always in contact with the braking member 12, which reduces a driving torque of the eccentric cam 10.

Examples of the housing 13 include, but are not limited to, a frame of the belt unit and a frame of the apparatus body.

Acceleration of the rotation of the eccentric cam 10 starts after the point 10*d* having a maximum rotation radius 10*e* passes a contact point between the slider 9 and the eccentric cam 10. Therefore, the braking member 12 is arranged to come into contact with a portion of the eccentric cam 10 when the contact point corresponds to a range from an arbitrary point between the point 10*c* and the point 10*d* to the point 10*a*. In other words, the braking member 12 does not come into contact with the eccentric cam 10 near the point 10*b* that is the beginning of the equilibrium area where the rotation torque rises to the maximum. Consequently, it is possible to prevent an increase in torque due to the braking member 12 from being added to the maximum rotation torque. This improves space efficiency and enables to downsize a motor of the driving unit 11, which prevents an increase in cost and apparatus size.

Specifically, the braking member 12 is arranged on the housing 13 to have a predetermined space from the point 10*b* of the eccentric cam 10 at which the rotation torque increases to the maximum. An elastic body such as sponge or rubber is used as the braking member 12 and a compressed amount of the braking member 12 is controlled by a space between the eccentric cam 10 and the housing 13. Therefore, it is possible to control a change of a braking force so that the braking force is stabilized, which achieves the utmost braking effect. In addition, a resin film such as a polyethylene terephthalate (PET) film is attached to a surface of the braking member 12 that comes into contact with the eccentric cam 10 to prevent the braking member 12 from being damaged due to a friction force between the braking member 12 and the eccentric cam 10.

The above explanation is given about the configuration in which the intermediate transfer belt 1 is brought into contact with the photosensitive element 8; however, the photosensitive element 8 can be brought into contact with the belt.

As described above, according to the first embodiment, with the braking member 12 that comes into contact with the outer periphery of the eccentric cam 10, the accelerating force can be controlled that is applied to the eccentric cam 10. Thus, collision noise caused by contact-separation operation of the primary transfer rollers 4*a* to 4*d* can be reduced. The braking member 12 is arranged to control the accelerating force applied to the eccentric cam 10 only by a predetermined angle, which minimizes the space occupied by the braking member 12. A braking force is not applied to the eccentric cam 10 in a range where the braking member 12 does not come into contact with the eccentric cam 10. Therefore, the eccentric cam 10 does not rotate beyond the maximum rotation torque. This improves space efficiency and prevents cost increase.

In the transfer belt unit, the housing 13 is arranged to have a predetermined space from the point 10*b* of the eccentric cam 10, and the braking member 12 made of an elastic material is compressed by a predetermined pressure. Therefore, the braking member 12 can maintain contact pressure constant with respect to the eccentric cam 10. This makes the braking force stable and achieves high braking effect.

A rotation torque of the eccentric cam 10 is set to satisfy the following relation:

$$A \geqq B + C$$

where A is the maximum rotation torque (a maximum value of the driving torque of the eccentric cam 10 when transfer members such as the primary transfer rollers 4*a* to 4*d* separate from the intermediate transfer belt 1 without the braking member 12), B is a rotation torque at the point 10*c* (fulcrum) in the equilibrium area (a maximum value of the driving torque at the point 10*c* in the equilibrium area when the transfer members separate from the intermediate transfer belt 1 without the braking member 12), and C is a torque generated by a braking force of the braking member 12 applied to the eccentric cam 10 rotating about its center (a friction force between the eccentric cam 10 and the braking member 12). Therefore, a rotation torque required for the driving unit can be the same as in configuration without the braking member 12. This prevents an increase in cost and apparatus size. The torque C can be set by adjusting hardness or thickness of the braking member 12 such as sponge or rubber, an amount of eccentricity of the eccentric cam 10, and a spring force of the spring 7.

Figure 7:
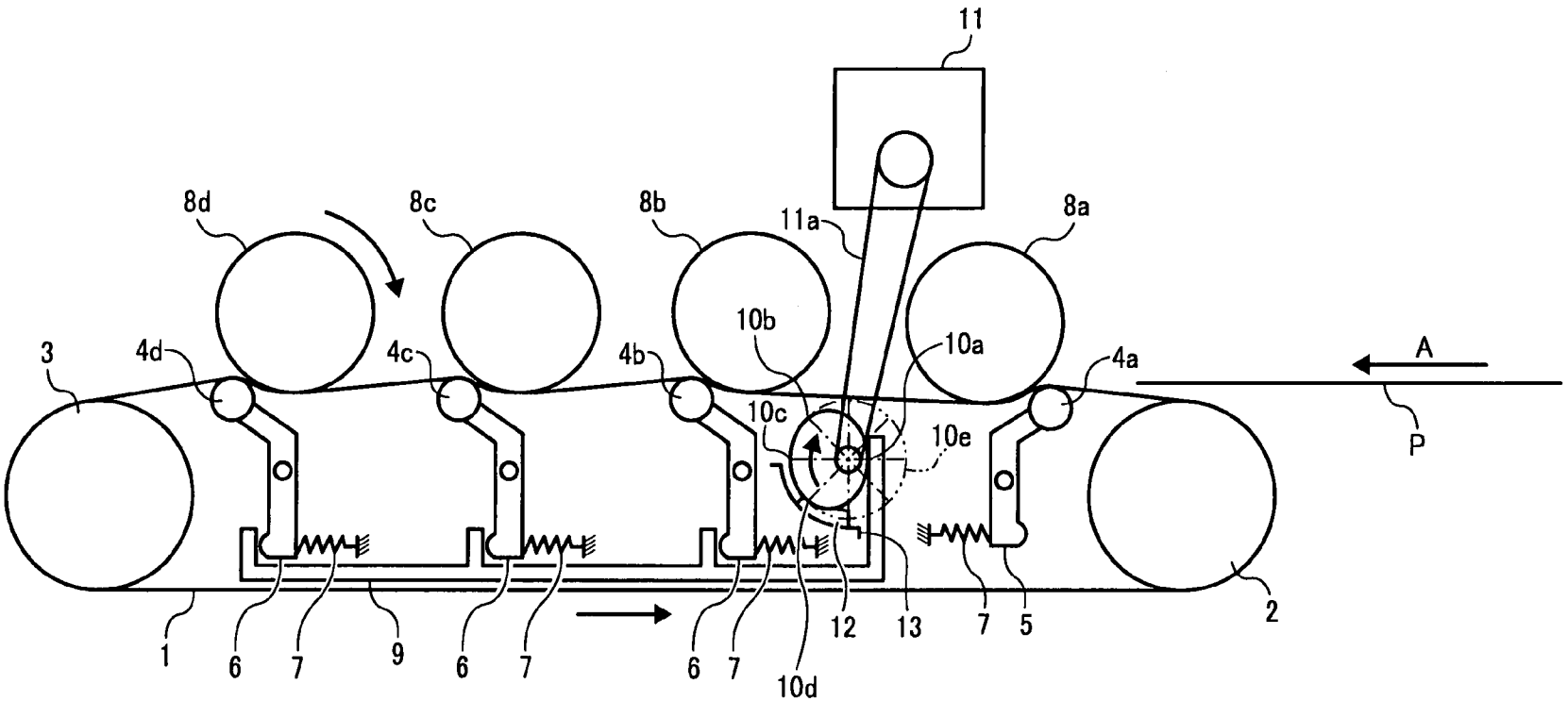
FIG. 7 is a schematic diagram of a transfer belt unit including a belt unit according to a second embodiment of the present invention.

While the image forming apparatus of the first embodiment is explained as an intermediate-transfer image forming apparatus, the image forming apparatus can also be of direct-transfer type. FIG. 7 is a schematic diagram of a direct-transfer tandem image forming apparatus according to a second embodiment of the present invention. Transfer rollers 4*a* to 4*d* correspond to the primary transfer rollers 4*a* to 4*d* of the first embodiment. Likewise, a carrier belt 1 that carries a recording medium P corresponds to the intermediate transfer belt 1. A recording medium P such as a sheet is carried in a direction indicated by an arrow A in FIG. 7, and passes through between the photosensitive elements 8*a* to 8*d* and the transfer rollers 4*a* to 4*d*. Toner images are sequentially transferred onto the recording medium P. Otherwise, the image forming apparatus of the second embodiment is of basically the same configuration and operate in the same manner as that of the first embodiment, and the same explanation is not repeated. Although FIG. 7 depicts an image forming apparatus for offset transfer in which a center of each of the transfer rollers 4*a* to 4*d* is not aligned with a perpendicular that is drawn from a center of each of the photosensitive elements 8*a* to 8*d* as an image carrier to the carrier belt 1, the transfer rollers 4*a* to 4*d* can be arranged right below the photosensitive elements 8*a* to 8*d*.

As set forth hereinabove, according to an embodiment of the present invention, it is possible to prevent a torque developing about an eccentric cam.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A belt unit comprising:

a belt;

a contact member that is configured to come into contact with the belt;

a movable member;

an eccentric cam mounted on a housing;

a contact-separation mechanism that allows the movable member to move based on rotation of the eccentric cam to control contact and separation between the contact member and the belt;

a braking unit, mounted on the housing, that controls the rotation of the eccentric cam by a predetermined angle, and a transfer member connected to the movable member and located to face the image carrier via the belt, wherein a braking force applied by the braking unit satisfies a relation A≧B+C where A is a maximum value of a driving torque of the eccentric cam without the braking unit when the transfer member separates from the belt, B is a maximum value of the driving torque at a fulcrum in an equilibrium area of the eccentric cam without the braking unit when the transfer member separates from the belt, and C is a torque acting about a center of the eccentric cam due to a braking force of the braking unit.

2. The belt unit according to claim 1, wherein the braking unit is made of an elastic member, and the braking unit is attached to the housing to be spaced apart by a predetermined distance from a portion of the eccentric cam with a maximum rotation radius.

3. The belt unit according to claim 1, wherein the braking unit is not mounted on the movable member.

4. The belt unit according to claim 1, wherein the movable member has a contact surface and the braking unit is mounted opposite the contact surface of the movable member.

5. A transfer belt unit for an image forming apparatus comprising:

a belt unit including a belt;

an image carrier that is configured to come into contact with the belt;

a movable member;

an eccentric cam mounted on the housing;

a contact-separation mechanism that allows the movable member to move based on rotation of the eccentric cam to control contact and separation between a contact member and the belt; and a braking unit, mounted on the housing, that controls the rotation of the eccentric cam by a predetermined angle; and a transfer member that is connected to the movable member and is located to face the image carrier via the belt, wherein the contact-separation mechanism controls contact and separation between the image carrier and the belt by moving the transfer member in a direction of the image carrier and in a direction opposite to the image carrier through a movement of the movable member, wherein a braking force applied by the braking unit satisfies a relation A≧B+C where A is a maximum value of a driving torque of the eccentric cam without the braking unit when the transfer member separates from the belt, B is a maximum value of the driving torque at a fulcrum in an equilibrium area of the eccentric cam without the braking unit when the transfer member separates from the belt, and C is a torque acting about a center of the eccentric cam due to a braking force of the braking unit.

6. The transfer belt unit according to claim 5, wherein the braking unit is not mounted on the movable member.

7. The transfer belt unit according to claim 5, wherein the transfer member includes a pivotable arm in contact with the movable member.

8. An image forming apparatus comprising a transfer belt unit that includes a belt unit including a belt;

an image carrier that is configured to come into contact with the belt;

a movable member;

an eccentric cam mounted on a housing;

a contact-separation mechanism that allows the movable member to move based on rotation of the eccentric cam to control contact and separation between a contact member and the belt; and a braking unit, mounted on the housing, that controls the rotation of the eccentric cam by a predetermined angle; and a transfer member that is connected to the movable member and is located to face the image carrier via the belt, wherein the contact-separation mechanism controls contact and separation between the image carrier and the belt by moving the transfer member in a direction of the image carrier and in a direction opposite to the image carrier through a movement of the movable member, and a braking force applied by the braking unit satisfies a relation A≧B+C where A is a maximum value of a driving torque of the eccentric cam without the braking unit when the transfer member separates from the belt, B is a maximum value of the driving torque at a fulcrum in an equilibrium area of the eccentric cam without the braking unit when the transfer member separates from the belt, and C is a torque acting about a center of the eccentric cam due to a braking force of the braking unit.

9. An image forming apparatus according to claim 8, wherein the braking unit is not mounted on the movable member.

* * * * *